US006598858B2

(12) United States Patent
Santa Cruz et al.

(10) Patent No.: US 6,598,858 B2
(45) Date of Patent: Jul. 29, 2003

(54) MULTIPURPOSE COMBINATION HAND TOOL

(76) Inventors: Cathy D. Santa Cruz, 7630 Tholl Dr., Reno, NV (US) 89506; Gary Gieratz, 1919 Hills Boro, Fallon, NV (US) 89406

( * ) Notice: Subject to any disclaimer, the term of this patent is extended or adjusted under 35 U.S.C. 154(b) by 0 days.

(21) Appl. No.: 09/957,213

(22) Filed: Sep. 19, 2001

(65) Prior Publication Data

US 2003/0052313 A1 Mar. 20, 2003

(51) Int. Cl.[7] ..... B25C 11/00; B66F 15/00

(52) U.S. Cl. ..... 254/26 R; 81/23; 81/26; 81/20

(58) Field of Search ..... 81/20, 21, 22, 81/23, 24, 25, 26, 27; 254/26 R, 18, 19, 26 E

(56) References Cited

U.S. PATENT DOCUMENTS

| | | | | | |
|---|---|---|---|---|---|
| 1,340,401 | A | * | 5/1920 | Olney | 254/26 R |
| 1,425,369 | A | * | 8/1922 | Coleman | 254/26 R |
| 1,695,339 | A | * | 12/1928 | Lochhead | 254/26 R |
| 2,542,603 | A | * | 2/1951 | Watters | 145/30 |
| 2,722,251 | A | * | 11/1955 | Dillon | 145/30 |
| 2,957,676 | A | * | 10/1960 | Palermo | 254/22 |
| 2,983,297 | A | * | 5/1961 | Wilson | 145/30 |
| 4,336,832 | A | * | 6/1982 | Poulos | 145/29 R |
| 5,159,858 | A | * | 11/1992 | Gansen | 81/23 |
| 6,339,974 | B1 | * | 1/2002 | Kotschner | 81/24 |

* cited by examiner

*Primary Examiner*—Joseph J. Hail, III
*Assistant Examiner*—Daniel Shanley

(57) ABSTRACT

A hand tool having novel features including an outwardly extending protrusion which provides a multitude of various angular substantially V-shaped extracting claws and a downwardly extending protrusion having fastener extracting means thereon, with the fastener extracting means being substantially formed from a cutout in the shape of a partial star interconnected with a teardrop.

2 Claims, 2 Drawing Sheets

MULTIPURPOSE COMBINATION HAND TOOL

FIELD OF THE INVENTION

This invention relates in general to hand tools that can be used for numerous applications of user choice, but more particularly pertains to a hand tool which is substantially in the form of a hammer or axe. With the tool being of novel construction including features which allow the user to easily remove nails, "or the like" even when the nail is embedded in an extremely difficult angle. Most importantly, the hand tool will not damage or mar the work surface which is typically incurred with use of other similar tools.

BACKGROUND OF THE INVENTION

In the past, numerous attempts have been made to provide hand tools that are functional for specific purposes, but most are not suitable for multiple uses. Therefore, the skilled worker must purchase lots of different types of tools in order to be versatile and prepared for any type of job which they may be requested to perform, and this can be extremely costly as well as very time consuming.

The following references are exemplary of some types of combination hand tools which have been devised to alleviate this problem, but even so the applicants contend such tools are still not as diversified and functional as is the present invention, as will be seen within the latter specification.

One of the newest types of hammers is taught within U.S. Pat. No. 6,122,788, entitled "HAMMER WITH ACCESSORIES", issued to Bruce Jefferson on Sep. 26, 2000. Wherein taught is a hammer having accessories such as a tape measurer and a compartment for containment of various articles including nails, picture hangers, tacks, screws, etc. This hammer is somewhat functional for use by those who are not skilled workers but simply use the hammer for menial jobs such as picture hanging or the like. It is to be understood that due to its construction it is not suitable for heavy-duty use, unlike the present invention which is most functional for skilled workers who use the tool on a daily basis.

Another example of related prior art is taught in U.S. Pat. No. 102,677, which is a very old reference entitled "IMPROVEMENT IN COMBINATION TOOL" and substantially comprises a hammer type tool having an internal compartment for containment of articles. Such as chisels, saws, gimlets, bradawls, screwdrivers, and tack-claws.

Further related prior art includes U.S. Pat. Nos. 4,273,172, 1,108,766 and 932,211, each of which provide hammer type tools and each are somewhat functional for their intended use. However, such references have inherent drawbacks and disadvantages which the present invention addresses and overcomes in a manner heretofore not taught within the known prior art, as will be seen and understood within the latter specification.

The applicants contend there is a great need for improvement in hand tools and such improvements should provide the user with various options and allow the user to easily perform multiple tasks in a simple efficient manner, such as taught within the present invention.

SUMMARY OF THE INVENTION

It is therefore an object of the present invention to provide a multipurpose combination hand tool which is novel in construction and includes unique features which overcome the drawbacks and disadvantages associated within the known prior art.

It is another object of the present invention to provide a multipurpose combination hand tool which is of simple construction and can be economically manufactured and easily marketed.

Yet another object of the present invention is to provide a multipurpose combination hand tool which includes a multitude of various angular substantially V-shaped extracting claws. This is most advantageous, as this allows the user to easily extract various fasteners such as nails or the like, even when such fasteners are embedded in a structure at a difficult angle, and the tool is especially useful when such fasteners are extremely bent. Most similar tools could not easily or efficiently extract such fasteners without great difficulty, as well as most of the prior art is extremely destructive to the work surface when used for such tasks.

It is a further object of the present invention to provide a multipurpose combination hand tool having a different type of fastener extraction means thereon which is most efficient for extraction of other articles, such as staples or tacks. Also it is most effective for removal of flooring as the tool when used properly does mar or damage the surface of the structure as commonly associated with the prior art. Furthermore, if so desired this type of fastener extraction means may be used as a "bottle opener" for novelty purposes.

Still a further object of the present invention is to provide a multipurpose combination hand toot having unique nail support means which is so constructed as to allow the support means to hold nails irrespective of size or shape. Also such support means may be used to insert a nail in an angular manner, and this is most useful when the tool cannot be easily maneuvered in close proximity to, or positioned near the work surface. For example, it is most suitable in situations where the worker is challenged with installation between roof rafters, between corners, or the like.

Also, another object of the present invention is to provide a multipurpose combination hand tool which further includes typical prior art elements such as a regular hammer head and a regular waffle type hammer head, or the like.

Yet another object of the present invention is to provide a multipurpose combination hand tool having unique features which may be incorporated into the shape and form of other types of tools, such as axes, shovels, hoes, etc.

Still a further object of the present invention is to provide a multipurpose combination hand tool which may be manufactured for either right or left hand use only, such as when the features of the present invention are incorporated into the construction of an axe, or the like.

Other objects and advantages will be seen when taken into consideration with the following drawings and specification.

DETAILED DESCRIPTION OF THE DRAWINGS

Figure 1:
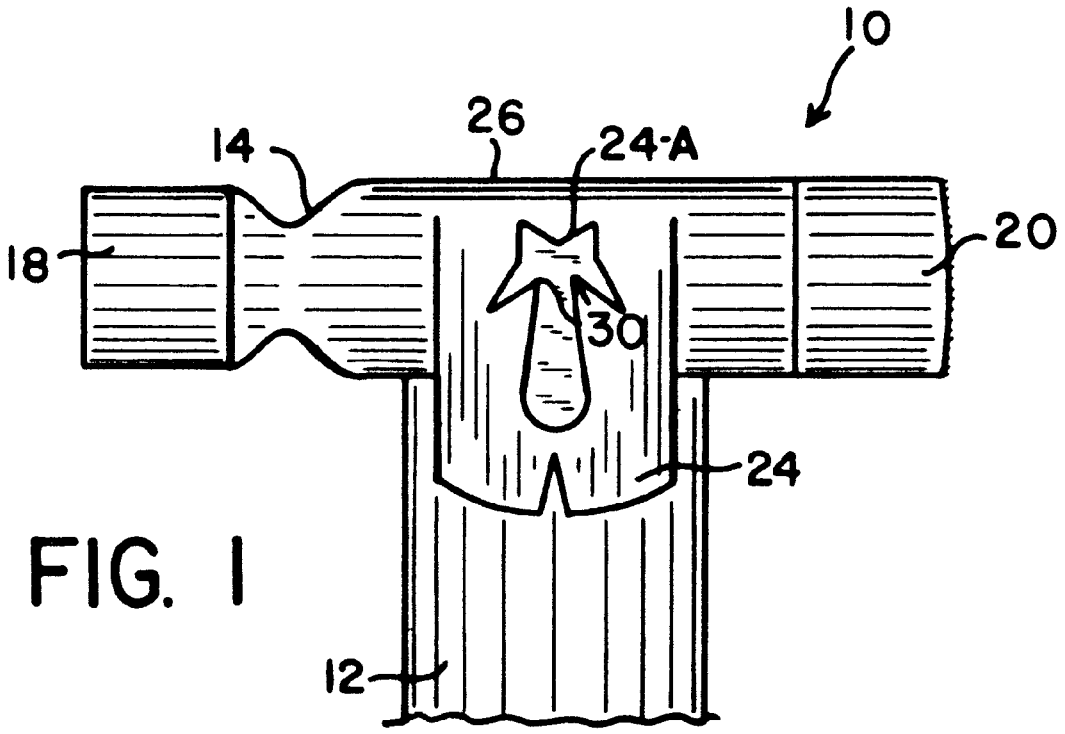
FIG. 1 is substantially a first side view illustrating the preferred embodiment for the present invention.
Figure 2:
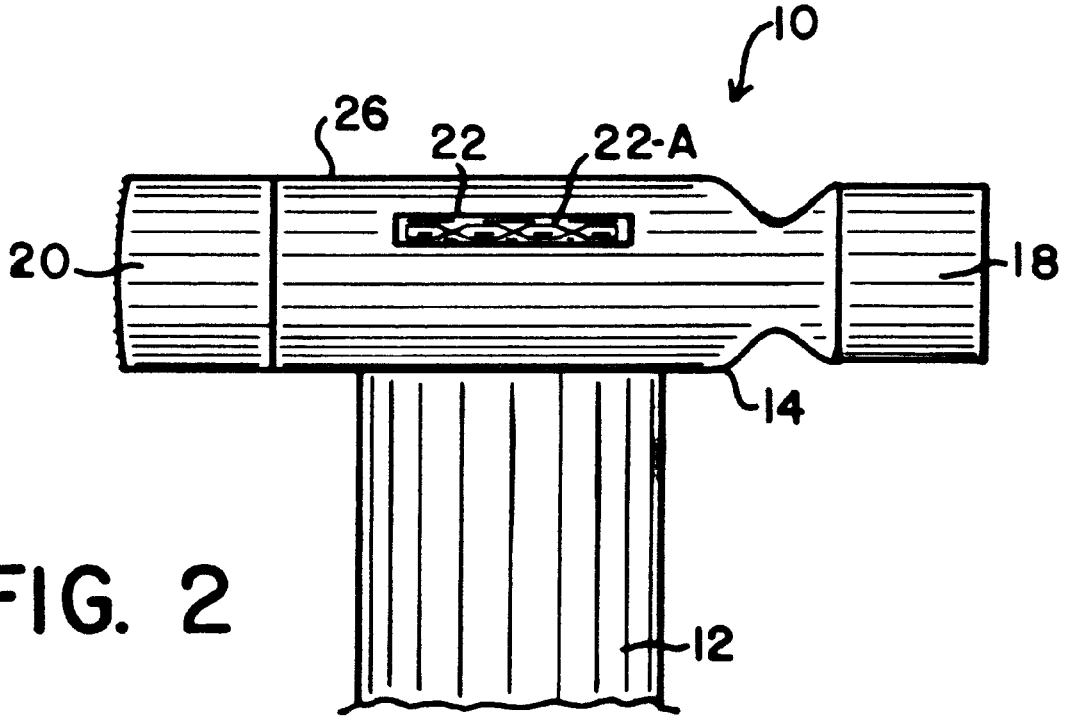
FIG. 2 is substantially a second side view illustrating the preferred embodiment for the present invention.
Figure 3:
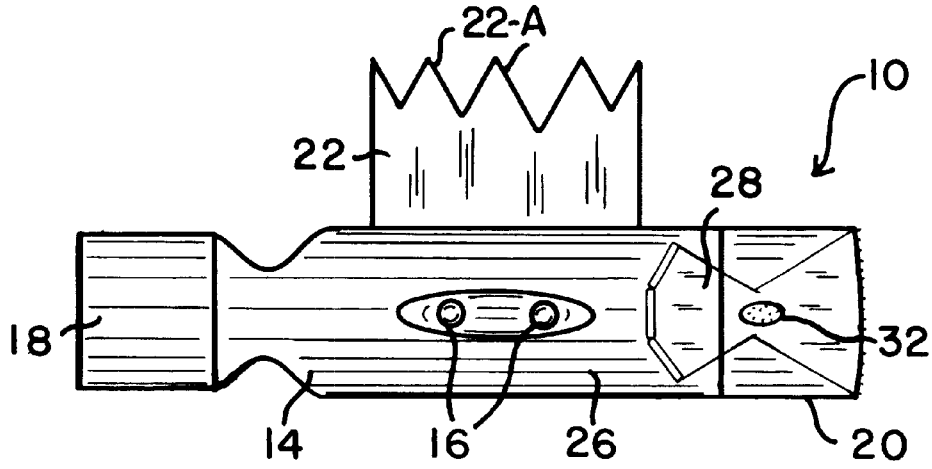
FIG. 3 is substantially a topside overview illustrating the preferred embodiment for the present invention.

Referring now in detail to the drawings wherein like characters refer to like elements throughout the various views. The present invention is substantially a multipurpose combination hand tool illustrated by overview (10) which represents the preferred embodiment for the present invention as depicted in FIGS. 1–3. Wherein, tool (10) substantially comprises an elongated body portion which forms a handle (12) and a tool head (14). The elongated body portion or handle (12) includes a top end and a bottom end, with the top end having tool head (14) fixedly attached thereon.

It is to be understood handle (12) can be manufactured from any suitable material of engineering choice, such as wood, rubber, steel, aluminum, etc., and can be of any suitable shape and size, as well as handle (12) may be ergonomically shaped and/or covered with a rubberized grip, (not shown) but it is to be inherent herein.

It is to be further understood that any suitable attachment means of engineering choice may be used for fixedly attaching tool head (14) onto handle (12). For example, as illustrated within FIG. 3, tool head (14) is fixedly attached onto handle (12) by typical prior art fasteners (16) but the invention is not to be limited to such fasteners as there are many types of suitable fasteners on the market. Also, tool head (14) may be manufactured from any suitable material of engineering choice, such as from tempered steel, or any other type of hard strong material that is very durable and which can withstand sudden impacts.

Tool head (14) substantially comprises a first end which is shaped so as to substantially form a typical standard type hammer head (18) and a second end which is shaped so as to substantially form a typical standard type waffle hammer head (20), with typical standard type hammer head (18) being substantially opposed to typical standard type waffle hammer head (20). Tool head (14) further having an outwardly extending protrusion (22) having a multitude of various angular substantially V-shaped extracting claws (22-A) extending there from, a downwardly extending protrusion (24) having fastener extracting means (24-A) thereon, and a flat top section (26), respectively, having nail support means (28) thereon.

Referring now in detail to the multitude of various angular substantially V-shaped extracting claws (22-A) which may include any number (but preferably more than one) of extracting claws of engineering choice. Also, each of the extracting claws (22-A) can be manufactured at various angles of engineering choice, such as each of the various angular substantially V-shaped extracting claws (22-A) may very in angle between 0–10 degrees, or the like. Whereby, each of the extracting claws provide different angles for easy extraction of fasteners depending on the angle of insertion of the fastener and alignment of the tool therewith. Also, various angular substantially V-shaped extracting claws (22-A) may be substantially equal in length or not equal in length, depending on engineering choice.

Referring now to fastener extracting means (24-A) which is substantially formed from a cutout, with the cutout being substantially cut so as to form the shape of a partial star interconnected with a teardrop, and the partial star forming at least two biting teeth (30) which are substantially bent outwardly away from tool head (14). Whereby, it can now be seen when at least two biting teeth (30) are positioned over a fastener (not shown) with the fastener being embedded within a support structure (not shown), the two biting teeth (30) bite into the support structure and simultaneously force the fastener to partially disengage from the support structure, and when the tear drop is positioned over the partially disengaged fastener, the tear drop can then be used to completely extract the fastener from within the support structure without marring or damaging the surface of the support structure. This is very important, as one would believe that the biting teeth would damage the surface of the support structure as typically incurred when using similar tools. However, after much experimentation by the applicants with the present tool, it has been found that the surface is not damaged at all, and this is especially useful when removing flooring or the like. Also, for novelty purposes the fastener extracting means (24-A) may be used as a bottle opener if so desired.

Referring now in detail to the nail support means (28) which is substantially formed from a cut-away section and is of a shape and size to allow a nail (not shown) to be angularly positioned therein at any angle of user choice relative to tool head (14). This is again very advantageous as this allows the user to hammer a nail into a support structure even when the tool cannot be easily maneuvered into close proximity to, or positioned near the support surface. Also, nail support means (28) includes a magnet (32) therein for securing a nail (not shown) within nail support means (28).

Figure 4:
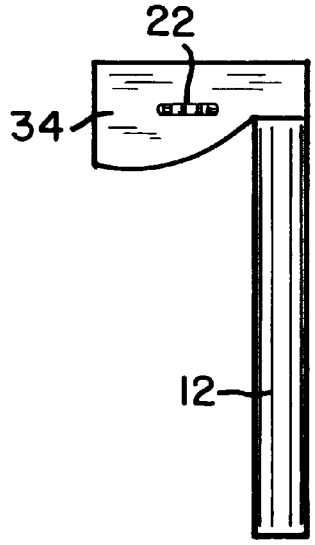
FIG. 4 is substantially a first side view illustrating a second embodiment for the present invention.
Figure 5:
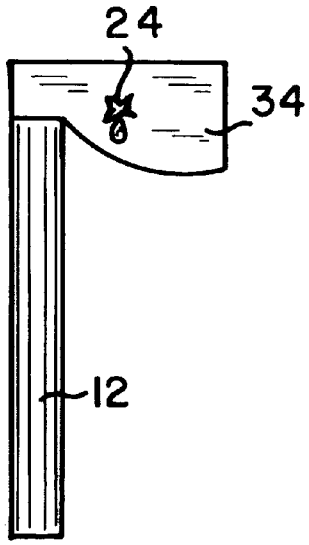
FIG. 5 is substantially a second side view illustrating a second embodiment for the present invention.
Figure 6:
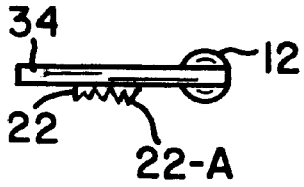
FIG. 6 is substantially a top view of the embodiment depicted in FIGS. 4 & 5.

Referring now in detail to FIGS. 4–6, wherein we depict a second embodiment for the present invention comprising an elongated body portion which forms a handle (12) and a tool head (34). Elongated body portion and/or handle (12) includes a top end and a bottom end with the top end having tool head (34) fixedly attached thereon, as previously described. Tool head (34) as presented within this embodiment, includes a first end which is shaped to substantially form a typical standard type axe head having the previously described outwardly extending protrusion (22) and a multitude of various angular substantially V-shaped extracting claws (22-A). Tool head (34) further includes downwardly extending protrusion (24) having fastener extracting means (24-A) thereon, as previously described. Thus it can now be seen, the unique features of the present invention, "namely, outwardly extending protrusion (22) with a multitude of various angular substantially V-shaped extracting claws (22-A) and downwardly extending protrusion (24) having fastener extracting means (24-A)" can easily be incorporated into the manufacture of substantially any suitable tool of choice, such as sledge hammers, shovels, ranks, etc.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatus's.

What we claim as new and wish to secure by Letters Patent is:

1. A multipurpose hand tool comprising: an elongated body portion which forms a handle, said elongated body portion having a top end and a bottom end, said top end having a tool head fixedly attached thereon, said tool head having a first end, a second end, an outwardly extending protrusion, a downwardly extending protrusion, and a flat top section, said first end being shaped to form a hammer head, said second end being shaped to form a waffle hammer head, said hammer head and said waffle hammer head being opposed to each other, said outwardly extending protrusion having a multitude of various angular V-shaped extracting claws, said flat top section having nail support means thereon, said downwardly extending protrusion having fastener extracting means thereon which is formed from a cutout, said cutout being cut so as to form the shape of a partial star interconnected with a teardrop and said partial star forming at least two biting teeth which are bent outwardly away from said tool head, whereby:

when said at least two biting teeth are positioned over a fastener with said fastener being embedded within a support structure, said at least two biting teeth bite into said support structure and force said fastener to partially disengage from said support structure, whereby:

when said tear drop is positioned over said fastener, said tear drop can then be used to completely extract said fastener from within said support structure without marring or damaging the surface of said support structure.

2. A multipurpose hand tool comprising: an elongated body portion which forms a handle, said elongated body portion having a top end and a bottom end, said top end having a tool head fixedly attached thereon, said tool head having a first end, an outwardly extending protrusion, a downwardly extending protrusion, and a flat top section, said first end being shaped to form an axe head, said outwardly extending protrusion having a multitude of various angular V-shaped extracting claws, said downwardly extending protrusion having fastener extracting means thereon which is formed from a cutout, said cutout being cut so as to form the shape of a partial star interconnected with a teardrop and said partial star forming at least two biting teeth which are bent outwardly away from said tool head.

* * * * *